United States Patent [19]

Cholat-Serpoud et al.

[11] 4,181,301

[45] Jan. 1, 1980

[54] TENNIS RACKET

[75] Inventors: Gerard Cholat-Serpoud, Sillans; Maurice Legrand, Voiron, both of France

[73] Assignee: Skis Rossignol S.A. Club Rossignol S.A. Societe Anonyme, Voiron, France

[21] Appl. No.: 818,734

[22] Filed: Jul. 25, 1977

[30] Foreign Application Priority Data

Jul. 28, 1976 [FR] France ..... 76 23758
Jul. 29, 1976 [FR] France ..... 76 24226

[51] Int. Cl.[2] ..... A63B 49/10
[52] U.S. Cl. ..... 273/73 C; 273/73 F
[58] Field of Search ..... 273/73 R, 73 C, 73 D, 273/73 F, 73 H, DIG. 7, DIG. 8

[56] References Cited

U.S. PATENT DOCUMENTS

| | | | |
|---|---|---|---|
| 3,208,761 | 9/1965 | Sullivan et al. | 273/73 F X |
| 3,690,658 | 9/1972 | Howe | 273/73 C |
| 3,816,573 | 6/1974 | Hashimoto et al. | 273/73 F X |
| 3,998,457 | 12/1976 | Dempsey et al. | 273/73 C |

FOREIGN PATENT DOCUMENTS

| | | | |
|---|---|---|---|
| 208945 | 7/1957 | Australia | 273/73 C |
| 2224316 | 11/1973 | Fed. Rep. of Germany | 273/73 H |
| 2270908 | 12/1975 | France | 273/73 F |
| 1122895 | 8/1968 | United Kingdom | 273/73 F |

*Primary Examiner*—Richard J. Apley
*Attorney, Agent, or Firm*—Karl F. Ross

[57] ABSTRACT

A tennis racket comprising an annular head and a shaft forming the handle, the head being spanned by stringing, has a pair of profiled members one of which is open-ended and forms the external periphery of the head and the sides of the shaft, the other profiled member being closed into a loop and forming the internal periphery of the head. The mutually opposite faces of the racket are constituted by two substantially flat parallel elements which form, together with the profiled members, a tubular structure whose interior is filled with a synthetic resin cast in situ. The confronting surfaces of the two profiled members are formed with grooves in which reduced edge portions of the flat elements are received to define the space filled with the synthetic resin.

11 Claims, 4 Drawing Figures

TENNIS RACKET

FIELD AND BACKGROUND OF THE INVENTION

The present invention relates to a tennis racket and, more particularly, to a tennis racket in which a handle-forming shaft and an annular head integral therewith, which is spanned by the stringing of the racket, are tubular and are filled with a core material such as polyurethane or another synthetic resin. Tennis rackets of this general type are already known.

OBJECT OF THE INVENTION

The object of the present invention is to provide an improved tennis racket of the type described which is of light weight, mechanically strong and easy to manufacture.

SUMMARY OF THE INVENTION

In accordance with this invention, we form the tubular structure of our improved tennis racket from a first wall member or profile, defining opposite sides of the shaft as well as the outer periphery of the annular head, and a second wall member or profile, defining the inner periphery of the head, these wall members having reinforced edges provided with confronting grooves. Two substantially flat, parallel wall elements, adjoining the profiled wall members generally orthogonally, define opposite planar faces and have peripheral ribs set back from these faces which are received in the grooves of the profiles.

Advantageously, the two profiles and the two orthogonally adjoining wall elements forming the planar frontal faces are constituted of synthetic-resin material which can be reinforced by inlaid woven reinforcements such as glass-fiber cloth, strands of graphite fiber, reinforcing wire or the like.

In a specific embodiment of one invention, each of the four walls of the hollow structure filled with the synthetic-resin material is constituted by an inner strip of metal covered externally with a synthetic-resin layer. The metal strip is advantageously constituted by an alloy of the ZICRAL type while the external resin layer preferably consists of a synthetic polyurethane-based elastomer. In a composite wall element of this nature, the metal strip may extend laterally beyond the resin layer to form the projecting peripheral ribs of reduced width engaging in the grooves of the profiled members.

BRIEF DESCRIPTION OF THE DRAWING

The above and other features of our present invention will become more readily apparent from the following description, reference being made to the accompanying drawing in which.

SPECIFIC DESCRIPTION

As in all tennis rackets, the racket of the present invention comprises a shaft 1 whose lower end is provided with a covering to form a hand-grip (not shown). At the other end of the shaft 1, the tennis racket has an annular head 2 strung with strands of synthetic-resin cord or with gut, the stringing being represented at 3.

Figure 2:
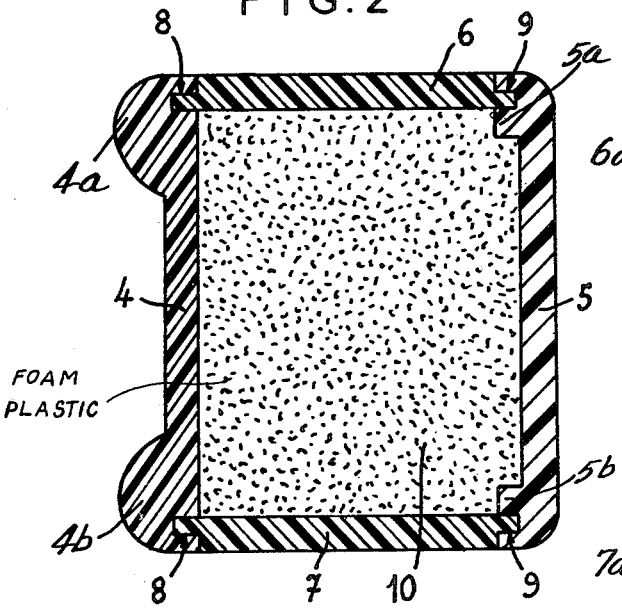
FIG. 2 is an enlarged cross-sectional view taken along the line II—II of FIG. 1.
Figure 3:
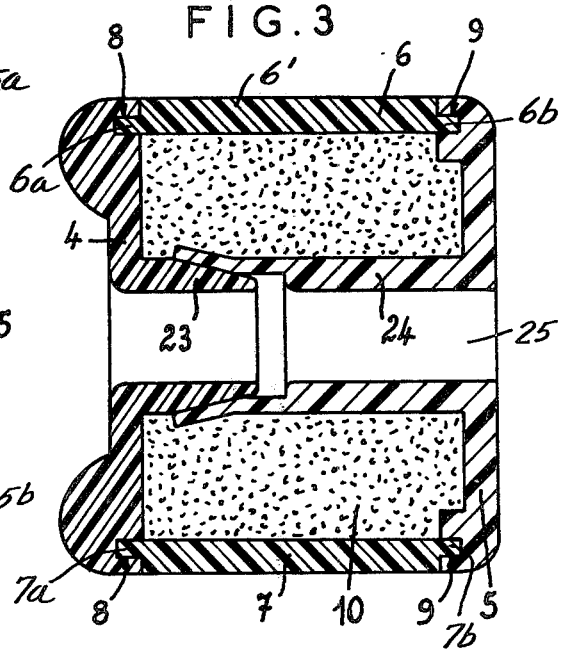
FIG. 3 is a cross-sectional view taken along the line III—III of FIG. 1, FIGS. 1–3 illustrating a first embodiment of the invention.

The shaft 1 and the head 2 are constituted, as shown in cross section in FIGS. 2 and 3, as a hollow body defined by two profiled wall members 4 and 5 and by two flat wall elements 6 and 7 forming the frontal faces 6' and 7' of the head and shaft. Profiles 4 and 5 can be composed of synthetic resin (preferred), extruded aluminum or aluminum alloy, magnesium or other light material. Profile 4 is open-ended and extends over the entire external periphery of head 2; it is formed with a pair of outwardly projecting beads *4a, 4b* defining a peripheral recess *4c* between them. Profile 4 can thus be considered as starting at the left-hand side at the free end of the shaft 1, passing upwardly along the shaft around the outer periphery of head 2 and then descending along the right-hand side of the shaft 1.

Profile 5 is closed into a loop and extends exclusively along the inner periphery of the head 2.

The profiled members 4 and 5 are each provided near the edges of their confronting surfaces with respective peripheral grooves 8 and 9, the grooves 8 and 9 adjacent each face of the racket being substantially coplanar.

The grooves 8 and 9 receive peripheral ribs *6a, 6b* and *7a, 7b* of reduced thickness of the two frontal elements 6 and 7 which are likewise constituted by a synthetic-resin material identical to or different from that forming the profiles 4 and 5. It will be noted that these grooves are formed in reinforced edges of these profiles constituted on the one hand by the bead-forming outer bulges *4a, 4b* and on the other hand by inner flanges *5a, 5b*.

The shaft 1 and the head 2 of our improved racket thus constitute a single hollow structure which is open at the free end of the shaft 1 and can be provided with a vent at the top of the racket head 2. The hollow body is filled with a synthetic-resin material, preferably of the foamable, kind such as polyurethane, which is injected into or cast in the interior of the structure and expands to fill the latter.

Figure 1:
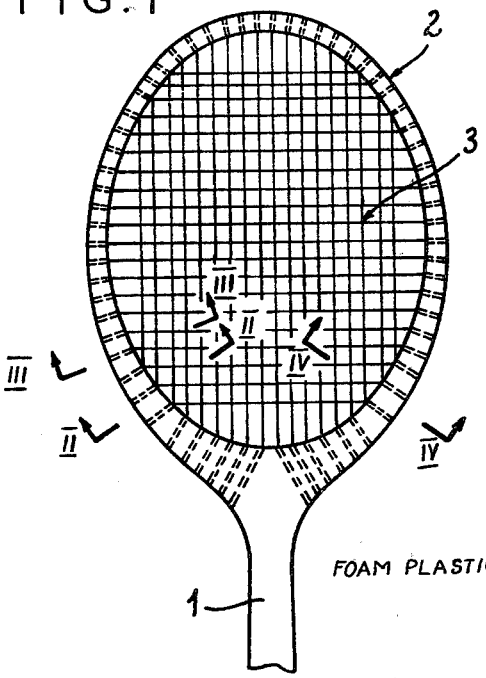
FIG. 1 is a plan view of a racket according to the present invention.
Figure 4:
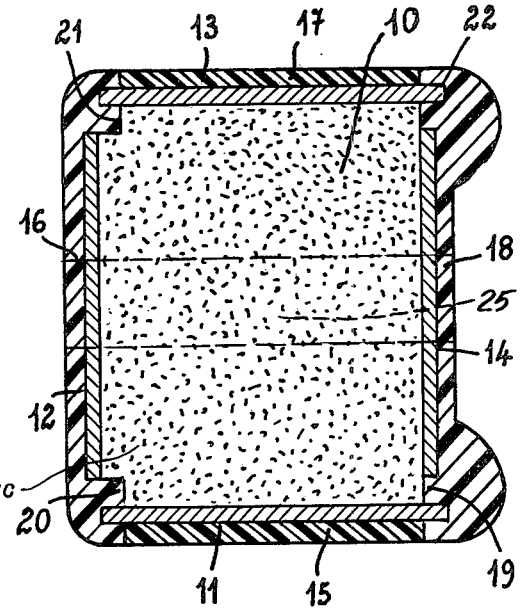
FIG. 4 is an enlarged cross-sectional view taken along a line corresponding to that shown at IV—IV of FIG. 1, illustrating a second embodiment of the invention.

In the embodiment illustrated in FIG. 4, each of the walls of the structure, i.e. profiled members 16, 18 and orthogonally adjoining elements 15, 17, is constituted by a respective metallic strip 11, 12, 13 and 14, advantageously composed of ZICRAL sheet. Each one of these strips is bonded to and partly received (in the case of the profiles) in an external covering of elastomeric material, e.g. of polyurethane. The wall members 12, 16 and 14, 18 again have reinforced edges provided with confronting grooves of the type described in connection with FIG. 2, adapted to receive the projecting edges of strips 11, 13 of wall elements 11, 15 and 13, 17 respectively. These grooves are formed only in the coatings 12, 14 so that the metal strips 14 are separated at each corner by elastomeric bridges 19, 20, 21 and 22 which cushion the stresses between the strips that result from the application of torsion forces. The synthetic-resin mass 10 fills the tubular body thus constituted.

In the embodiment of FIG. 4, as in the embodiment of FIGS. 2 and 3, the outer faces of the walls 5, 7 or 11, 15 and 13, 17 are flush with the outer edges of the profiles 4, 5 and 16, 18 respectively.

Because of the cushioning zones 19 - 22, the shear effects resulting from the torsional forces which are applied to the head of the racket do not result in any fissuring or cracking of the core material 10. This is of course not only the result of the elasticity and yieldability of the core material but also a result of the elasticity of the covering layers 15 - 18 of the metallic strips 11–14 which are interconnected not directly but only through the intermediary of the resilient material of the coverings.

The stringing 13 can extend through passages 25 formed by axially interfitting tubular bosses 23 and 24, the female boss 24 having a flexible terminal portion which can be spread by the frustoconical outer configuration of the male boss 23 (see FIG. 3). The passages 25, opening outwardly onto the peripheral recess 4*c*, thus remain free from the material constituting the core and there is no danger to the stringing from the core material and vice versa.

We claim:

1. In a tennis racket comprising a first and a second profiled wall member, said first wall member being open-ended and defining opposite sides of a shaft and the outer periphery of an annular head integral with said shaft, said second wall member forming a closed loop which defines the inner periphery of said head, and further comprising a pair of substantially flat parallel wall elements defining opposite planar faces of said shaft and said head, said wall members and said wall elements adjoining one another generally orthogonally and forming between them a closed space filled with a synthetic mass, the improvement wherein said wall members have reinforced edges provided with confronting grooves, said wall elements having peripheral ribs set back from said planar faces and received in said grooves.

2. The improvement defined in claim 1 wherein said wall members are provided between said grooves with mating tubular bosses extending into said space and defining passages for strings traversing said head.

3. The improvement defined in claim 2 wherein the reinforced edges of said first wall member form externally projecting beads defining between them a peripheral recess, said passages opening outwardly onto said recess.

4. The improvement defined in claim 1 wherein said wall members are composed of a synthetic-resin material.

5. The improvement defined in claim 1 wherein said wall members are composed of a reinforced synthetic-resin material.

6. The improvement defined in claim 1 wherein said wall elements are composed of synthetic resin material.

7. The improvement defined in claim 1 wherein said wall members and said wall elements are each formed with an inner metallic strip covered by an outer layer of a synthetic-resin material, the strips of said wall elements being wider than their covering layers and forming said peripheral ribs.

8. The improvement defined in claim 7 wherein said strips are each constituted of ZICRAL alloy and said layers are composed of a polyurethane elastomer.

9. The improvement defined in claim 7 wherein adjacent metallic strips of said wall elements and said wall members are separated by portions of the outer layers of said wall members forming said grooves.

10. The improvement defined in claim 1 wherein said mass is composed of polyurethane.

11. The tennis racket defined in claim 1 wherein said mass is composed of a foamed polyurethane.

* * * * *